US012612569B2

(12) United States Patent
Bera et al.

(10) Patent No.: US 12,612,569 B2
(45) Date of Patent: Apr. 28, 2026

(54) FUEL COMPOSITIONS

(71) Applicant: SHELL USA, INC., Houston, TX (US)

(72) Inventors: Tushar Kanti Bera, Houston, TX (US); Kimberly Ann Johnson, Houston, TX (US); Allen Ambwere Aradi, Houston, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 18/552,461

(22) PCT Filed: Apr. 21, 2022

(86) PCT No.: PCT/EP2022/060541
§ 371 (c)(1),
(2) Date: Sep. 26, 2023

(87) PCT Pub. No.: WO2022/228989
PCT Pub. Date: Nov. 3, 2022

(65) Prior Publication Data

US 2024/0182804 A1 Jun. 6, 2024

Related U.S. Application Data

(60) Provisional application No. 63/179,781, filed on Apr. 26, 2021.

(51) Int. Cl.
*C10L 1/04* (2006.01)

(52) U.S. Cl.
CPC ..... *C10L 1/04* (2013.01); *C10L 2200/04* (2013.01); *C10L 2230/22* (2013.01); *C10L 2270/02* (2013.01)

(58) Field of Classification Search
CPC ..... C10L 1/04; C10L 2230/22; C10L 2270/02
See application file for complete search history.

(56) References Cited

U.S. PATENT DOCUMENTS 4,010,622 A * 3/1977 Etter ..... F17C 1/005 48/190
4,072,811 A 2/1978 Oosterwijk et al.
(Continued)

FOREIGN PATENT DOCUMENTS

CN 1368999 A 9/2002
EP 0147240 A2 7/1985
(Continued)

OTHER PUBLICATIONS

International Search Report and Written Opinion received for PCT Patent Application No. PCT/EP2022/060541, mailed on Aug. 23, 2022, 10 pages.
(Continued)

*Primary Examiner* — Ellen M Mcavoy
*Assistant Examiner* — Ming Cheung Po
(74) *Attorney, Agent, or Firm* — SHELL USA, INC.

(57) ABSTRACT

Fuel composition comprising: (a) a base fuel suitable for use in an internal combustion engine; (b) a tetraalkylethane compound having the formula (I): wherein Ar represents an aryl group and each X is independently selected from a hydrogen atom, substituted or unsubstituted, straight chain or branched $C_1$-$C_{12}$ alkyl group, $(CH_2)nOH$ or $(CH_2)nNH_2$, wherein n is in the range of 1 to 9, provided that at least one of the X groups in each $CX_3$ group is a hydrogen atom; and c) an alkylbenzene compound having the formula (II) wherein each $R_1$-$R_6$ group is independently selected from hydrogen and a $C_1$-$C_{15}$ alkyl group, wherein at least one of the $R_1$-$R_6$ groups is a $C_1$-$C_6$ alkyl group. The fuel composition of the present invention provides improved power and acceleration benefits, as well as increased flame speed and burn duration.
(Continued)

(I)

(II)

16 Claims, 4 Drawing Sheets

(56) References Cited

U.S. PATENT DOCUMENTS 4,208,190 A 6/1980 Malec
4,849,572 A 7/1989 Chen et al.
4,877,416 A 10/1989 Campbell
5,004,478 A 4/1991 Vogel et al.
5,112,364 A 5/1992 Rath et al.
5,186,722 A * 2/1993 Cantrell ..... C10G 1/08 585/947
5,298,039 A 3/1994 Mohr et al.
5,378,348 A 1/1995 Davis et al.
5,385,588 A * 1/1995 Brennan ..... C10L 1/143 44/451
5,393,309 A 2/1995 Cherpeck
5,490,864 A 2/1996 Herbstman et al.
5,660,601 A 8/1997 Oppenländer et al.
5,689,031 A 11/1997 Berlowitz et al.
5,746,786 A 5/1998 Mueller et al.
5,766,274 A 6/1998 Wittenbrink et al.
5,772,705 A 6/1998 Caprotti
5,855,629 A 1/1999 Grundy et al.
5,876,468 A 3/1999 Moreton
5,888,376 A 3/1999 Wittenbrink et al.
5,997,592 A 12/1999 Lin et al.
6,069,281 A 5/2000 Kropp et al.
6,140,541 A 10/2000 Melder et al.
6,162,956 A 12/2000 Berlowitz et al.
6,180,842 B1 1/2001 Berlowitz et al.
6,204,426 B1 3/2001 Miller et al.
6,267,791 B1 7/2001 Thomas et al.
6,274,029 B1 8/2001 Wittenbrink et al.
6,544,407 B1 4/2003 Calemma et al.
6,616,776 B1 * 9/2003 Ahmadi ..... C11D 3/43 134/40
6,663,767 B1 12/2003 Berlowitz et al.
6,787,022 B1 9/2004 Berlowitz et al.
6,833,064 B2 12/2004 Berlowitz et al.
6,860,909 B2 3/2005 Berlowitz et al.
7,252,754 B2 8/2007 DeHaan et al.
7,435,273 B2 10/2008 Lange et al.
7,546,834 B1 * 6/2009 Ulrey ..... F02D 19/0692 123/576
7,901,470 B2 3/2011 Graupner et al.
8,273,138 B2 9/2012 Bauldreay et al.
8,372,164 B2 2/2013 Haan et al.
8,486,876 B2 7/2013 Brewer et al.
8,518,130 B2 8/2013 Croft et al.
8,557,001 B2 10/2013 Brewer et al.
8,628,594 B1 1/2014 Braly
8,709,111 B2 4/2014 Felix-Moore et al.
8,741,002 B2 6/2014 Felix-Moore et al.
2008/0168706 A1 7/2008 Rusek et al.
2009/0013591 A1 * 1/2009 Bradin ..... C10L 1/02 44/452
2010/0000484 A1 1/2010 Felix-Moore et al.
2010/0154733 A1 6/2010 Brewer
2011/0088311 A1 4/2011 Bower et al.
2012/0277133 A1 * 11/2012 DiBiase ..... C11C 3/00 44/392
2013/0008081 A1 1/2013 Weaver
2017/0009166 A1 * 1/2017 Roucis ..... C10L 3/10
2019/0100708 A1 * 4/2019 Roucis ..... C10L 10/02

FOREIGN PATENT DOCUMENTS

EP 0310875 A1 4/1989
EP 0482253 A1 4/1992
EP 0583836 A1 2/1994
EP 0613938 A1 9/1994
GB 960493 A 6/1964
WO 9842808 A1 10/1998
WO 0020535 A1 4/2000

OTHER PUBLICATIONS

Egolfopoulos et al., "Advances and Challenges in Laminar Flame Experiments and Implications for Combustion Chemistry", Progress in Energy and Combustion Science, 2014, pp. 1-32.
Gillespie et al., "Aspects of Laminar and Turbulent Burning Velocity Relevant to SI Engines", Journal of the Society of Automotive Engineers, 2000, 21 pages.
Mittal et al., "Fast Mass-fraction-burned Calculation Using the Net Pressure Method for Real-time Applications", Proceedings of the Institution of Mechanical Engineers Part D Journal of Automobile Engineering, 2009, vol. 223, pp. 389-394.
Wei et al., "The Lubricity of Diesel Fuels", Wear, 1986, vol. 111, pp. 217-235.
Dievart et al., "The Combustion Properties of 1,3,5-trimethylbenzene and a Kinetic Model", Fuel, 2013, vol. 109, pp. 125-136.
Office Action Received for Chinese Application No. 202280027997.2, Mailed on Jul. 19, 2025, 13 Pages(6 Pages of English Translation and 7 Pages of Official Copy).

* cited by examiner

FUEL COMPOSITIONS

CROSS REFERENCE TO RELATED APPLICATIONS

This is a National stage application of International Application No. PCT/EP2022/060541, filed 21 Apr. 2022, which claims priority of U.S. Provisional Application No. 63/179,781 filed 26 Apr. 2021 which is incorporated herein by reference in its entirety.

FIELD OF THE INVENTION

The present invention relates to a liquid fuel composition, in particular to a liquid fuel composition having improved power and/or acceleration properties. The present invention also relates to a method of improving the power and/or acceleration properties of an internal combustion engine by fueling the internal combustion engine with the liquid fuel composition described herein below.

BACKGROUND OF THE INVENTION

Laminar burning velocity (also referred to as "flame speed") is a fundamental combustion property of any fuel/air mixture. As taught in SAE 2012-01-1742 formulating gasoline fuel blends having faster burning velocities can be an effective strategy for enhancing engine and vehicle performance. Faster burning fuels can lead to a more optimum combustion phasing resulting in a more efficient energy transfer and hence a faster acceleration and better performance.

Increasing ignition delay time (IDT) sufficiently to allow for optimization of spark timing during the power stroke in a spark-ignition internal combustion engine (SI-ICE) provides the best opportunity to calibrate for optimal efficiency. In addition, if the fuel is modified so that the ignition delay time increase is caused by inhibition of the chemical radical reactions that occur before the spark, and a shift of these same reactions further up the temperature/pressure trajectory of the cycle to occur after the spark, then combustion improvement can be achieved through increased flame speeds resulting in shorter burn duration. Ability to control flame speed, and burn duration collectively enable the SI-ICE to be calibrated to achieve the best balance between fuel economy, power and acceleration expressed in the term "break thermal efficiency" (BTE).

It has now surprisingly been found that the use of a particular combination of additive components in a liquid fuel composition can provide benefits in terms of increased flame speed, reduced burn duration, increased burn rate, improved power output, improved acceleration performance and improved fuel economy. Surprisingly the present invention achieves this without affecting the Ignition Delay Time (IDT).

SUMMARY OF THE INVENTION

According to the present invention there is provided a fuel composition comprising:

(a) a base fuel suitable for use in an internal combustion engine;

(b) a tetraalkylethane compound having the formula (I):

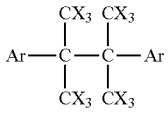

(I)

wherein Ar represents an aryl group and each X is independently selected from a hydrogen atom, substituted or unsubstituted, straight chain or branched $C_1$-$C_6$ alkyl group, OH, $(CH_2)_nOH$, $(CH_2)_nNH_2$, wherein n is from 1 to 9, provided that at least one of the X groups in each $CX_3$ group is a hydrogen atom; and c) an alkylbenzene compound having the formula (II)

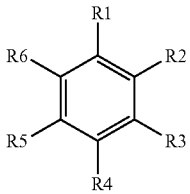

(II)

wherein each R1-R6 group is independently selected from hydrogen and a $C_1$-$C_6$ alkyl group, wherein at least one of the R1-R6 groups is a $C_1$-$C_6$ alkyl group.

It has been surprisingly found that the fuel compositions of the present invention provide increased flame speed, reduced burn duration, increased burn rate, improved power output and improved acceleration performance. Surprisingly the present invention achieves this without effecting the Ignition Delay Time (IDT).

According to another aspect of the present invention there is provided a method of improving the power output of an internal combustion engine, said method comprising fueling the internal combustion engine with a liquid fuel composition described herein below.

According to yet another aspect of the present invention there is provided a method of improving the acceleration of an internal combustion engine, said method comprising fueling the internal combustion engine with a liquid fuel composition described herein below.

According to yet another aspect of the present invention there is provided a method of increasing the flame speed of a liquid fuel composition in an internal combustion engine, said method comprising fueling the internal combustion engine with a liquid fuel composition described herein below.

According to yet another aspect of the present invention there is provided a method of reducing the burn duration of a liquid fuel composition in an internal combustion engine, said method comprising fueling the internal combustion engine with a liquid fuel composition described hereinbelow.

According to yet another aspect of the present invention there is provided a method of increasing the burn rate of a liquid fuel composition in an internal combustion engine, said method comprising fueling the internal combustion engine with a liquid fuel composition described hereinbelow.

According to yet another aspect of the present invention there is provided the use of a liquid fuel composition as described herein for improving power output.

According to yet another aspect of the present invention there is provided the use of a liquid fuel composition as described herein for improving acceleration.

According to yet another aspect of the present invention, there is provided the use of a liquid fuel composition for increasing the flame speed.

According to yet another aspect of the present invention there is provided the use of a liquid fuel composition for reducing the burn duration.

DETAILED DESCRIPTION OF THE INVENTION

Figure 1:
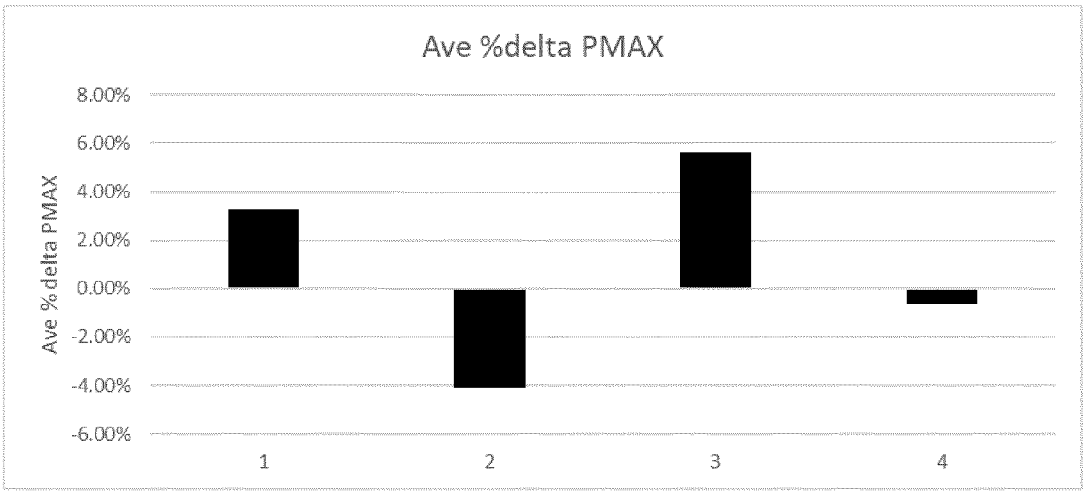
FIG. 1 is a graphical representation of the experimental data set out in Table 4.

In order to assist with the understanding of the invention several terms are defined herein.

The term "power output" as used herein refers to the amount of resistance power required to maintain a fixed speed at wide open throttle conditions in Chassis Dynamometer testing.

According to the present invention, there is provided a method of improving the power output of an internal combustion engine, said method comprising fueling the internal combustion engine containing a lubricant with a liquid fuel composition described hereinbelow. In the context of this aspect of the invention, the term "improving" embraces any degree of improvement. The improvement may for instance be 0.05% or more, preferably 0.1% or more, more preferably 0.2% or more, even more preferably 0.5% or more, especially 1% or more, more especially 2% or more, even more especially 5% or more, of the power output of an analogous fuel formulation, prior to adding a tetraalkylethane compound, and also an alkylbenzene compound, to it in accordance with the present invention. The improvement in power output may even be as high as 10% of the power output of an analogous fuel formulation, prior to adding a tetraalkylethane compound and an alkylbenzene compound to it in accordance with the present invention.

In accordance with the present invention, the power output provided by a fuel composition may be determined in any known manner.

The term "acceleration" as used herein refers to the amount of time required for the engine to increase in speed between two fixed speed conditions in a given gear.

According to the present invention, there is provided a method of improving the acceleration of an internal combustion engine, said method comprising fueling the internal combustion engine containing a lubricant with a liquid fuel composition described hereinbelow. In the context of this aspect of the invention, the term "improving" embraces any degree of improvement. The improvement may for instance be 0.05% or more, preferably 0.1% or more, more preferably 0.2% or more, even more preferably 0.5% or more, especially 1% or more, more especially 2% or more and even more especially 5% or more of the acceleration provided by an analogous fuel formulation, prior to adding a tetraalkylethane compound and an alkylbenzene compound to it in accordance with the present invention. The improvement in acceleration may even be as high as 10% of the acceleration provided by an analogous fuel formulation, prior to adding a tetraalkylethane compound and an alkylbenzene compound to it in accordance with the present invention.

In accordance with the present invention, the power output and acceleration provided by a fuel composition may be determined in any known manner for instance using the standard test methods as set out in SAE Paper 2005-01-0239 and SAE Paper 2005-01-0244.

The term "flame speed" or 'laminar flame speed' (LFS) as used herein refers to laminar burning velocity. LFS is a fundamental measure of flame propagation rate without complication of mixing dynamics. However, in an engine, mixing dynamics play a role, so the measured flame speed is referred to as 'burn rate' and 'burn duration'. The terms 'burn rate' and 'burn duration' is also used herein interchangeably with 'flame speed'. Laminar Burning Velocity (LBV) is a fundamental property of a chemical component. It is defined as the rate (normal to the flame front, under laminar flow conditions) at which unburnt gas propagates to the flame front and reacts to form products.

According to the present invention, there is provided a method of increasing the flame speed of an Internal combustion engine, said method comprising fueling the internal combustion engine with a liquid fuel composition described herein below. In the context of this aspect of the invention, the term "increasing" embraces any degree of increase. The increase may for instance be 0.05% or more, preferably 0.1% or more, more preferably 1% or more, and especially 5% or more of the flame speed of an analogous fuel formulation, prior to adding the claimed additives to it in accordance with the present invention. The increase in flame speed may be at most 10% of the flame speed of an analogous fuel formulation, prior to adding the claimed additives to it in accordance with the present invention.

However, it should be appreciated that any measurable improvement in power output, acceleration and flame speed may provide a worthwhile advantage, depending on what other factors are considered important, e.g. availability, cost, safety and so on.

In accordance with the present invention, the flame speed of a fuel composition may be determined in any known manner, for instance measurement of LFS can be performed using any one of the following three methods:

1. Stagnation flame method (up to 5-7 atm)
2. Spherically expanding method, either constant pressure or constant volume (up to 60-80 atm)
3. The heat flux method (up to 5 atm or so).

All three of these methods are described in the review publication: Egolfopoulos, F. N., Hansen, N., Ju, Y., Kohse-Höinghaus, K., Law, C. K., and Qi, F. "Advances and challenges in laminar flame experiments and implications for combustion chemistry", Progress in Energy and Combustion Science 43 (2014) 36-67, https://doi.org/10.1016/j.pecs.2014.04.004.

The following method for measuring flame speed in a constant volume combustion chamber (spherical bomb), ref Gillespie, L. L., M.; Sheppard, C. G.; Wooley, R, *Aspects of laminar and turbulent burning velocity relevant to spark ignition engines*, Journal of the Society of Automotive Engineers, 2000 (2000-01-0192).

The following method for measuring flame speed uses a net pressure method: Mittal, M., Zhu, G. and Schock H., 'Fast mass-fraction-burned calculation using the net pressure method for real-time applications', Proc. Instn Mech Engrs, Part D: J. Automobile Engineering 223 (3) (2009): 389-394.

The term 'burn duration' as used herein means the time required (in engine crank angle degrees) for combustion to progress from 10% to 90% (referred to as AI 10-90 in the Examples below). In the Examples below, the term AI 50-90 is also used in relation to burn duration and means the time required (in engine crank angle degrees) for combustion to progress from 50% to 90%.

In accordance with the present invention, the burn duration of a fuel composition may be determined in any known manner, for instance using the test method disclosed in the Examples section hereinbelow.

However, it should be appreciated that any measurable improvement in power output, acceleration, burn duration and flame speed may provide a worthwhile advantage, depending on what other factors are considered important, e.g. availability, cost, safety and so on.

The liquid fuel composition of the present invention comprises a base fuel suitable for use in an internal combustion engine, a tetraalkylethane compound and am alkylbenzene compound. Typically, the base fuel suitable for use in an internal combustion engine is a gasoline or a diesel fuel, and therefore the liquid fuel composition of the present invention is typically a gasoline composition or a diesel fuel composition.

The tetraalkylethane compound used herein is a compound having the formula (I):

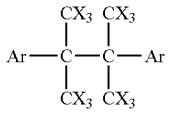

(I)

wherein Ar represents an aryl group and each X is independently selected from a hydrogen atom, substituted or unsubstituted, straight chain or branched $C_1$-$C_{12}$ saturated or unsaturated alkyl group, $(CH_2)_nOH$, $(CH_2)_nNH_2$, wherein n is in the range from 1 to 9, preferably in the range from 1 to 6, more preferably in the range from 1 to 4, even more preferably in the range from 1 to 3, provided that at least one of the X groups in each $CX_3$ group is a hydrogen atom.

Preferably, at least two of the X groups in each $CX_3$ group is a hydrogen atom.

In an especially preferred embodiment, three of the X groups in each $CX_3$ group is a hydrogen atom.

Preferably, the Ar of the tetraalkylethane compound is a substituted or unsubstituted aromatic group, such as a phenyl, biphenyl, naphthyl, thienyl or anthracyl. More preferably, Ar is an unsubstituted phenyl group. This means that for the preparation of the preferred compound of formula (I) it is possible to start out with cumene, which is commercially available. Starting with cumene, dicumene can be prepared by several known methods, as described in U.S. Pat. No. 4,072,811.

Preferably, each X group is independently selected from a hydrogen atom and an unsubstituted, straight chain or branched, saturated or unsaturated $C_1$-$C_6$, more preferably $C_1$-$C_3$, alkyl group, provided that at least one of the X groups in each $CX_3$ group is a hydrogen atom.

More preferably, each X group is independently selected from a hydrogen atom and an unsubstituted, straight chain or branched, saturated $C_1$-$C_6$, preferably $C_1$-$C_3$, alkyl group, provided that at least one of the X groups in each $CX_3$ group is a hydrogen atom.

In one embodiment, each X group is independently selected from a hydrogen atom, and an unsubstituted straight chain, saturated $C_1$-$C_6$, preferably $C_1$-$C_3$, alkyl group, especially methyl, ethyl and propyl.

Examples of suitable tetraalkylethane compounds of Formula (I) include:

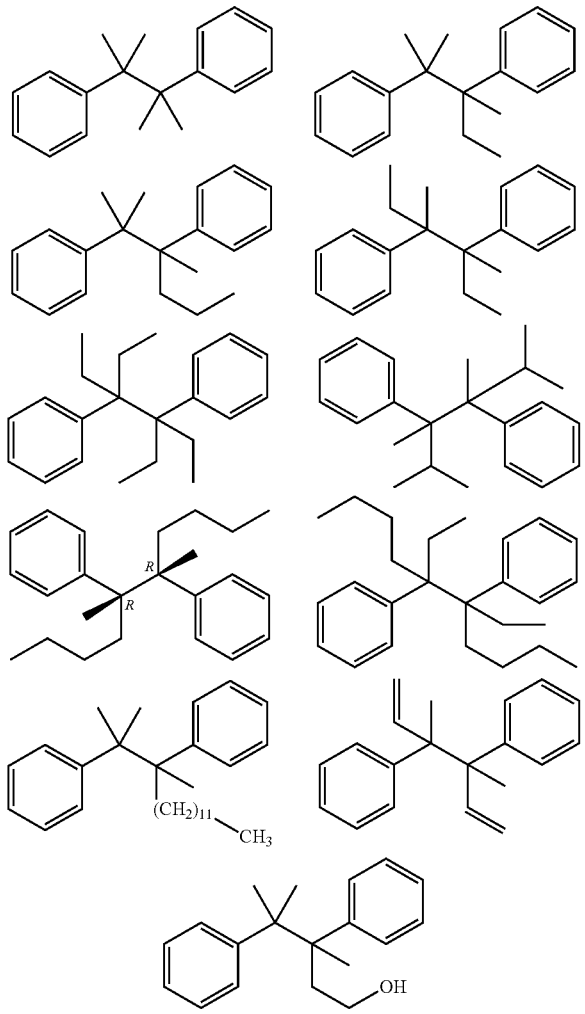

In one embodiment herein the tetralkylethane compound is 1,1' (1,1,2,2-tetramethyl-1,1-ethanediyl)bis-benzene (dicumene). Dicumene is commercially available from Aldrich and various other chemical suppliers.

The tetraalkylethane compound is preferably present in the fuel composition at a level from 30 ppm to 10 wt %, preferably from 100 ppm to 5 wt %, more preferably from 100 ppm to 1 wt %, even more preferably from 100 ppm to 5000 ppm, especially from 500 ppm to 2000 ppm, by weight of the fuel composition.

In addition to the tetraalkylethane compound described above, the fuel compositions of the present invention also comprise an alkylbenzene compound having a formula (II) below:

(II)

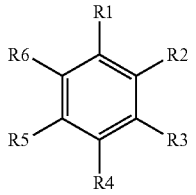

wherein each R1-R6 group is independently selected from hydrogen and a $C_1$-$C_6$ alkyl group, wherein at least one of the R1-R6 groups is a $C_1$-$C_6$ alkyl group.

It has been found that by using a combination of a tetraalkylethane compound and an alkylbenzene compound improvements in power, acceleration, flame speed, burn duration properties can be obtained.

In preferred embodiments herein, three R1-R6 groups in the alkylbenzene compound are independently selected from a $C_1$-$C_6$ alkyl group.

In a preferred embodiment herein the alkylbenzene compound is a trimethylbenzene compound.

In a particularly preferred embodiment herein the alkylbenzene compound is 1,3,5-trimethylbenzene. 1,3,5-trimethylbenzene is commercially available from Aldrich and other chemical suppliers.

The alkylbenzene compound is preferably present in the fuel composition at a level from 30 ppm to 2 wt %, preferably from 100 ppm to 1 wt %, more preferably from 100 ppm to 5000 ppm, even more preferably from 500 ppm to 2000 ppm, by weight of the fuel composition.

The tetraalkylethane compound and the alkylbenzene compound may be blended together with any other additives e.g. additive performance package(s) to produce an additive blend. The additive blend is then added to a base fuel to produce a liquid fuel composition.

The amount of performance package(s) in the additive blend is preferably in the range of from 0.1 to 99.8 wt %, more preferably in the range of from 5 to 50 wt %, by weight of the additive blend.

Preferably, the amount of the performance package present in the liquid fuel composition of the present invention is in the range of 15 ppmw (parts per million by weight) to 10% wt, based on the overall weight of the liquid fuel composition. More preferably, the amount of the performance package present in the liquid fuel composition of the present invention additionally accords with one or more of the parameters (i) to (xv) listed below:

(i) at least 100 ppmw
(ii) at least 200 ppmw
(iii) at least 300 ppmw
(iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 5000 ppmw
(xiii) at most 10000 ppmw
(xiv) at most 2% wt.
(xv) at most 5% wt.

In the liquid fuel compositions of the present invention, if the base fuel used is a gasoline, then the gasoline may be any gasoline suitable for use in an internal combustion engine of the spark-ignition (petrol) type known in the art, including automotive engines as well as in other types of engine such as, for example, off road and aviation engines. The gasoline used as the base fuel in the liquid fuel composition of the present invention may conveniently also be referred to as 'base gasoline'.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline may be at least 80, for instance in the range of from 80 to 110, preferably the RON of the gasoline will be at least 90, for instance in the range of from 90 to 110, more preferably the RON of the gasoline will be at least 91, for instance in the range of from 91 to 105, even more preferably the RON of the gasoline will be at least 92, for instance in the range of from 92 to 103, even more preferably the RON of the gasoline will be at least 93, for instance in the range of from 93 to 102, and most preferably the RON of the gasoline will be at least 94, for instance in the range of from 94 to 100 (EN 25164); the motor octane number (MON) of the gasoline may conveniently be at least 70, for instance in the range of from 70 to 110, preferably the MON of the gasoline will be at least 75, for instance in the range of from 75 to 105, more preferably the MON of the gasoline will be at least 80, for instance in the range of from 80 to 100, most preferably the MON of the gasoline will be at least 82, for instance in the range of from 82 to 95 (EN 25163).

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40 percent by volume based on the gasoline (ASTM D1319); preferably, the olefinic hydrocarbon content of the gasoline is in the range of from 0 to 30 percent by volume based on the gasoline, more preferably, the olefinic hydrocarbon content of the gasoline is in the range of from 0 to 20 percent by volume based on the gasoline.

Typically, the aromatic hydrocarbon content of the gasoline is in the range of from 0 to 70 percent by volume based on the gasoline (ASTM D1319), for instance the aromatic hydrocarbon content of the gasoline is in the range of from 10 to 60 percent by volume based on the gasoline; preferably, the aromatic hydrocarbon content of the gasoline is in the range of from 0 to 50 percent by volume based on the gasoline, for instance the aromatic hydrocarbon content of the gasoline is in the range of from 10 to 50 percent by volume based on the gasoline.

In one embodiment herein the gasoline base fuel comprises less than 10 vol % of aromatics, based on the total base fuel. In another embodiment herein, the gasoline base fuel comprises less than 2 vol % of aromatics having 9 carbon atoms or greater, based on the total base fuel.

The benzene content of the gasoline is at most 10 percent by volume, more preferably at most 5 percent by volume, especially at most 1 percent by volume based on the gasoline.

The gasoline preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably has a low total lead content, such as at most 0.005 g/l, most preferably being lead free—having no lead compounds added thereto (i.e. unleaded).

When the gasoline comprises oxygenated hydrocarbons, at least a portion of non-oxygenated hydrocarbons will be substituted for oxygenated hydrocarbons (match-blending) or simply added to the fully formulated gasoline (splash-blending). The oxygenate content of the gasoline may be up to 85 percent by weight (EN 1601) (e.g. ethanol per se) based on the gasoline. For example, the oxygenate content of the gasoline may be up to 35 percent by weight, preferably up to 25 percent by weight, more preferably up to 10 percent by weight. Conveniently, the oxygen concentration will have a minimum concentration selected from any one of 0, 0.2, 0.4, 0.6, 0.8, 1.0, and 1.2 percent by weight, and a maximum concentration selected from any one of 12, 8, 7.2, 5, 4.5, 4.0, 3.5, 3.0, and 2.7 percent by weight.

Examples of oxygenated hydrocarbons that may be incorporated into the gasoline include alcohols, ethers, esters, ketones, aldehydes, carboxylic acids and their derivatives, and oxygen containing heterocyclic compounds. Preferably, the oxygenated hydrocarbons that may be incorporated into the gasoline are selected from alcohols (such as methanol, ethanol, propanol, 2-propanol, butanol, tert-butanol, isobutanol and 2-butanol), ethers (preferably ethers containing 5 or more carbon atoms per molecule, e.g., methyl tert-butyl ether and ethyl tert-butyl ether) and esters (preferably esters containing 5 or more carbon atoms per molecule); a particularly preferred oxygenated hydrocarbon is ethanol.

When oxygenated hydrocarbons are present in the gasoline, the amount of oxygenated hydrocarbons in the gasoline may vary over a wide range. For example, gasolines comprising a major proportion of oxygenated hydrocarbons are currently commercially available in countries such as Brazil and U.S.A., e.g. ethanol per se and E85, as well as gasolines comprising a minor proportion of oxygenated hydrocarbons, e.g. E10 and E5. Therefore, the gasoline may contain up to 100 percent by volume oxygenated hydrocarbons. E100 fuels as used in Brazil are also included herein. Preferably, the amount of oxygenated hydrocarbons present in the gasoline is selected from one of the following amounts: up to 85 percent by volume; up to 70 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline may contain at least 0.5, 1.0 or 2.0 percent by volume oxygenated hydrocarbons.

Examples of suitable gasolines include gasolines which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Also suitable for use herein are gasoline blending components which can be derived from sources other than crude oil, such as low carbon gasoline fuels from either biomass or $CO_2$, and blends thereof with each other or with fossil-derived gasoline streams and components. Suitable examples of such fuels include:

1) Biomass Derived:
   a. Straight run bio-naphthas from hydrodeoxygenation of biomass, and
   b. cracked and/or isomerized products of syn-wax by the (biomass gasification to syngas ($CO/H_2$) to syn-wax by the FT process), which is then hydrocracked/hydroisomerized to yield a slate of products including cuts in the gasoline distillation range.
2) $CO_2$ Derived:
   a. $CO_2$+$H_2$ syngas ($CO/H_2$) by modified water/gas shift reaction to syn-wax by the FT process), which is then hydrocracked/hydroisomerized to yield a slate of products including cuts in the gasoline distillation range.
3) Methanol Derived:
   a. Biomass gasification to syngas ($CO/H_2$) to Methanol to MTG gasoline (MTG is 'methanol-to-gasoline' process). To reduce the carbon intensity of the fuel further, the $H_2$ used in all processes would be renewable (green) $H_2$ from electrolysis of water using renewable electricity such as from wind and solar.

Particularly suitable for use herein are gasoline blending components which can be derived from a biological source. Examples of such gasoline blending components can be found in WO2009/077606, WO2010/028206, WO02010/000761, European patent application nos. 09160983.4, 09176879.6, 09180904.6, and U.S. patent application Ser. No. 61/312,307.

Whilst not critical to the present invention, the base gasoline or the gasoline composition of the present invention may conveniently include one or more optional fuel additives, in addition to the essential tetraalkylethane compound and the essential alkylbenzene compound mentioned above. The concentration and nature of the optional fuel additive(s) that may be included in the base gasoline or the gasoline composition of the present invention is not critical. Non-limiting examples of suitable types of fuel additives that can be included in the base gasoline or the gasoline composition of the present invention include anti-oxidants, corrosion inhibitors, detergents, dehazers, antiknock additives, metal deactivators, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the base gasoline or the gasoline composition of the present invention.

The (active matter) concentration of any optional additives present in the base gasoline or the gasoline composition of the present invention is preferably up to 1 percent by weight, more preferably in the range from 5 to 2000 ppmw, advantageously in the range of from 300 to 1500 ppmw, such as from 300 to 1000 ppmw.

As stated above, the gasoline composition may also contain synthetic or mineral carrier oils and/or solvents.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly (internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the hazing that might otherwise occur when the gasoline without the dehazer contacts water, and this amount will be referred to herein as a "haze-inhibiting amount." Generally, this amount is from about 0.1 to about 20 ppmw (e.g. from about 0.1 to about 10 ppm), more preferably from 1 to 15 ppmw, still more preferably from 1 to 10 ppmw, advantageously from 1 to 5 ppmw based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g. p-phenylenediamine, N,N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclo-pentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO 03/076554. Optionally anti valve seat recession additives may be used such as sodium or potassium salts of polymeric organic acids.

The gasoline compositions herein can also comprise a detergent additive. Suitable detergent additives include those disclosed in WO2009/50287, incorporated herein by reference.

Preferred detergent additives for use in the gasoline composition herein typically have at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties;

(A6) polyoxy-$C_2$— to —$C_4$-alkylene groups which are terminated by hydroxyl groups, mono- or polyamino groups, in which at least one nitrogen atom has basic properties, or by carbamate groups;

(A8) moieties derived from succinic anhydride and having hydroxyl and/or amino and/or amido and/or imido groups; and/or (A9) moieties obtained by Mannich reaction of substituted phenols with aldehydes and mono- or polyamines.

The hydrophobic hydrocarbon radical in the above detergent additives, which ensures the adequate solubility in the base fluid, has a number-average molecular weight (Mn) of from 85 to 20 000, especially from 113 to 10 000, in particular from 300 to 5000. Typical hydrophobic hydrocarbon radicals, especially in conjunction with the polar moieties (A1), (A8) and (A9), include polyalkenes (polyolefins), such as the polypropenyl, polybutenyl and polyisobutenyl radicals each having Mn of from 300 to 5000, preferably from 500 to 2500, more preferably from 700 to 2300, and especially from 700 to 1000.

Non-limiting examples of the above groups of detergent additives include the following:

Additives comprising mono- or polyamino groups (A1) are preferably polyalkenemono- or polyalkenepolyamines based on polypropene or conventional (i.e. having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylene-triamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further preferred additives comprising monoamino groups (A1) are the compounds obtainable from polyisobutene epoxides by reaction with amines and subsequent dehydration and reduction of the amino alcohols, as described in particular in DE-A-196 20 262.

Additives comprising polyoxy-$C_2$-$C_4$-alkylene moieties (A6) are preferably polyethers or polyetheramines which are obtainable by reaction of $C_2$- to $C_{60}$-alkanols, $C_6$— to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyether-amines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising moieties derived from succinic anhydride and having hydroxyl and/or amino and/or amido and/or imido groups (A8) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine. Such additives are described in particular in U.S. Pat. No. 4,849,572.

Additives comprising moieties obtained by Mannich reaction of substituted phenols with aldehydes and mono- or polyamines (A9) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Preferably, the detergent additive used in the gasoline compositions of the present invention contains at least one nitrogen-containing detergent, more preferably at least one nitrogen-containing detergent containing a hydrophobic hydrocarbon radical having a number average molecular weight in the range of from 300 to 5000. Preferably, the nitrogen-containing detergent is selected from a group comprising polyalkene monoamines, polyetheramines, polyalkene Mannich amines and polyalkene succinimides. Conveniently, the nitrogen-containing detergent may be a polyalkene monoamine.

In the above, amounts (concentrations, % vol, ppmw, % wt) of components are of active matter, i.e. exclusive of volatile solvents/diluent materials.

In the liquid fuel compositions of the present invention, if the base fuel used is a diesel fuel, then the diesel fuel used as the base fuel in the present invention includes diesel fuels for use in automotive compression ignition engines, as well as in other types of engine such as for example off road, marine, railroad and stationary engines. The diesel fuel used as the base fuel in the liquid fuel composition of the present invention may conveniently also be referred to as 'diesel base fuel'.

The diesel base fuel may itself comprise a mixture of two or more different diesel fuel components, and/or be additivated as described below.

Such diesel fuels will contain one or more base fuels which may typically comprise liquid hydrocarbon middle distillate gas oil(s), for instance petroleum derived gas oils. Such fuels will typically have boiling points within the usual diesel range of 150 to 400° C., depending on grade and use. They will typically have a density from 750 to 1000 kg/m$^3$, preferably from 780 to 860 kg/m$^3$, at 15° C. (e.g. ASTM D4502 or IP 365) and a cetane number (ASTM D613) of from 35 to 120, more preferably from 40 to 85. They will typically have an initial boiling point in the range 150 to 230° C. and a final boiling point in the range 290 to 400° C. Their kinematic viscosity at 40° C. (ASTM D445) might suitably be from 1.2 to 4.5 mm$^2$/s.

An example of a petroleum derived gas oil is a Swedish Class 1 base fuel, which will have a density from 800 to 820 kg/m$^3$ at 15° C. (SS-EN ISO 3675, SS-EN ISO 12185), a T95 of 320° C. or less (SS-EN ISO 3405) and a kinematic viscosity at 40° C. (SS-EN ISO 3104) from 1.4 to 4.0 $mm^2/s$, as defined by the Swedish national specification EC1.

Also suitable for use herein are diesel blending components which can be derived from sources other than crude oil, such as low carbon diesel fuels from either biomass or $CO_2$ and blends thereof which each other or with fossil-derived diesel streams and components. Suitable examples of such fuels include:

1) Biomass Derived:
   a. Straight run bio diesel from hydrodeoxygenation of biomass, and
   b. cracked and/or isomerized products of syn-wax (biomass gasification to syngas ($CO/H_2$) to syn-wax by the FT process), which is then hydrocracked/hydroisomerized to yield a slate of products including cuts in the diesel distillation range.
2) $CO_2$ Derived:
   a. $CO_2$+$H_2$ syngas ($CO/H_2$) by modified water/gas shift reaction to syn-wax by the FT process), which is then hydrocracked/hydroisomerized to yield a slate of products including cuts in the diesel distillation range.
3) Methanol Derived:
   a. Biomass gasification to syngas ($CO/H_2$) to Methanol to MTD (MTD is 'methanol-to-diesel' process). To reduce the carbon intensity of the fuel further, the $H_2$ used in all processes would be renewable (green) $H_2$ from electrolysis of water using renewable electricity such as from wind and solar.

Fischer-Tropsch fuels may for example be derived from natural gas, natural gas liquids, petroleum or shale oil, petroleum or shale oil processing residues, coal or biomass.

The amount of Fischer-Tropsch derived fuel used in the diesel fuel may be from 0% to 100% v of the overall diesel fuel, preferably from 5% to 100% v, more preferably from 5% to 75% v. It may be desirable for such a diesel fuel to contain 10% v or greater, more preferably 20% v or greater, still more preferably 30% v or greater, of the Fischer-Tropsch derived fuel. It is particularly preferred for such diesel fuels to contain 30 to 75% v, and particularly 30 to 70% v, of the Fischer-Tropsch derived fuel. The balance of the diesel fuel is made up of one or more other diesel fuel components.

Such a Fischer-Tropsch derived fuel component is any fraction of the middle distillate fuel range, which can be isolated from the (optionally hydrocracked) Fischer-Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400° C., preferably to about 370° C. Examples of Fischer-Tropsch derived kerosene and gas oils are described in EP-A-0583836, WO-A-97/14768, WO-A-97/14769, WO-A-00/11116, WO-A-00/11117, WO-A-01/83406, WO-A-01/83648, WO-A-01/83647, WO-A-01/83641, WO-A-00/20535, WO-A-00/20534, EP-A-1101813, U.S. Pat. Nos. 5,766,274, 5,378,348, 5,888,376 and 6,204,426.

The Fischer-Tropsch product will suitably contain more than 80 wt % and more suitably more than 95 wt % iso and normal paraffins and less than 1 wt % aromatics, the balance being naphthenics compounds. The content of sulphur and nitrogen will be very low and normally below the detection limits for such compounds. For this reason the sulphur content of a diesel fuel composition containing a Fischer-Tropsch product may be very low.

The diesel fuel composition preferably contains no more than 5000 ppmw sulphur, more preferably no more than 500 ppmw, or no more than 350 ppmw, or no more than 150 ppmw, or no more than 100 ppmw, or no more than 70 ppmw, or no more than 50 ppmw, or no more than 30 ppmw, or no more than 20 ppmw, or most preferably no more than 10 ppmw sulphur.

Other diesel fuel components for use herein include the so-called "biofuels" which derive from biological materials. Examples include fatty acid alkyl esters (FARE). Examples of such components can be found in WO2008/135602. Fully hydrogenated FAAEs are also available and called 'renewable diesel'. Biofuels can be derived from animal oils or vegetable oils.

Renewable diesel fuels from solid bio mass and bio oil can be used herein, such as that disclosed in US2013/0008081A1.

The diesel base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents.

Detergent-containing diesel fuel additives are known and commercially available. Such additives may be added to diesel fuels at levels intended to reduce, remove, or slow the build-up of engine deposits.

Examples of detergents suitable for use in diesel fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

The diesel fuel additive mixture may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; combustion improvers; static dissipator additives; cold flow improvers; and wax anti-settling agents.

The diesel fuel additive mixture may contain a lubricity enhancer, especially when the diesel fuel composition has a low (e.g. 500 ppmw or less) sulphur content. In the additivated diesel fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "The Lubricity of Diesel Fuels", Wear, III (1986) 217-235;
- WO-A-95/33805—cold flow improvers to enhance lubricity of low sulphur fuels;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It may also be preferred for the diesel fuel composition to contain an anti-foaming agent, more preferably in combination with an anti-rust agent and/or a corrosion inhibitor and/or a lubricity enhancing additive.

Unless otherwise stated, the (active matter) concentration of each such optional additive component in the additivated diesel fuel composition is preferably up to 10000 ppmw, more preferably in the range from 0.1 to 1000 ppmw, advantageously from 0.1 to 300 ppmw, such as from 0.1 to 150 ppmw.

The (active matter) concentration of any dehazer in the diesel fuel composition will preferably be in the range from 0.1 to 20 ppmw, more preferably from 1 to 15 ppmw, still more preferably from 1 to 10 ppmw, and especially from 1 to 5 ppmw. The (active matter) concentration of any ignition improver present will preferably be 2600 ppmw or less, more preferably 2000 ppmw or less, even more preferably 300 to 1500 ppmw. The (active matter) concentration of any detergent in the diesel fuel composition will preferably be in the range from 5 to 1500 ppmw, more preferably from 10 to 750 ppmw, most preferably from 20 to 500 ppmw.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives in the diesel fuel composition may be suitably between 0 and 10000 ppmw and preferably below 5000 ppmw.

In the above, amounts (concentrations, % vol, ppmw, % wt) of components are of active matter, i.e. exclusive of volatile solvents/diluent materials.

The liquid fuel composition of the present invention can be produced by admixing the essential tetraalkylethane compound and alkylbenzene compound with a base fuel suitable for use in an internal combustion engine. Since the base fuel to which the essential fuel additive is admixed is a gasoline, then the liquid fuel composition produced is a gasoline composition; likewise, if the base fuel to which the additive is admixed is a diesel fuel, then the liquid fuel composition produced is a diesel fuel composition.

It has surprisingly been found that the use a combination of a tetraalkylethane compound and an alkylbenzene compound as described herein in liquid fuel compositions provides benefits in terms of improved power, improved acceleration, reduced burn duration, increased flame speed and improved fuel economy of an internal combustion engine being fueled by the liquid fuel composition containing said tetraalkylethane compound and said alkylbenzene compound relative to the internal combustion engine being fueled by the liquid base fuel.

The present invention will be further understood from the following examples. Unless otherwise stated, all amounts and concentrations disclosed in the examples are based on weight of the fully formulated fuel composition.

Examples

The goal of these experiments was to screen a set of additives with potential for combustion enhancing properties using the gasoline single cylinder engine (GSCE). Combustion enhancement could be shown in basically two modes: pre-ignition delay (octane boosting, important for reduced knock at high compression ratio) or flame speed improver (shortened burn duration leading to improved power).

A number of fully formulated fuel compositions are provided below (Examples 1 to 4).

All fuel compositions use the same base fuel. The base fuel is an E10 fuel (containing 10% ethanol) meeting North American maingrade specification ASTM D4814 containing no performance additive.

1,3,5-trimethylbenzene (TMB) and/or dicumene were added into the base fuel at the treat rates indicated in Table 1 below. Table 1 also shows the RON and MON values for each fuel formulation.

TABLE 1

| Example | TMB (ppm) | Dicumene (ppm) | RON | MON | RON − MON |
|---|---|---|---|---|---|
| 1 (Comparative) | | 5000 ppm | 90.9 | 85.5 | 5.4 |
| 2 (Comparative) | 5000 ppm | | 92.1 | 86.7 | 5.4 |
| 3 (1:1) | 5000 ppm | 5000 ppm | 91.4 | 84.9 | 6.5 |
| 4 (10:1) | 5 wt % | 5000 ppm | 92.9 | 85.2 | 7.7 |
| Base Fuel | 0 | 0 | 92.2 | 86 | 6.2 |

Test Conditions

The engine used for these experiments was the Gasoline single cylinder engine. This engine was manufactured by AVL and based on the EA888 2.0 L Audi TFSI/VW TSI (Euro 6). The single cylinder bench engine details are shown in Table 2 below.

TABLE 2

| Parameter: | Details: |
|---|---|
| Manufacturer | AVL |
| Displaced Volume | 454 $cm^3$ |
| Cylinders | 1 |
| Stroke | 86 mm |
| Bore | 82 mm |
| Compression ratio | Variable 8-12, (10:1 chosen) |
| Number of valves | 2 inlet; 2 outlet |
| Maximum engine speed | 5000 rpm (3300 rpm chosen) |
| Aspiration | Slightly Boosted (max 2.5 bar absolute) |
| Injection | PFI (solenoid injector) |
| Other | IMEP up to 25 bar, Max. peak pressure 130 bar continuous |

The engine test conditions are detailed below in Table 3.

TABLE 3

| Engine test conditions | Speed [RPM] | IMEP [Bar] | Intake pressure [mbara] | Intake temp. [° C.] | Exhaust back pressure [mbara] | Fuel pressure [bar] | Fuel temp [° C.] |
|---|---|---|---|---|---|---|---|
| 1300HL | 1300 | 11.5 | 1110 | 35 | 1080 | 3 | 25 |
| 1300ML | 1300 | 8 | 905 | 35 | 1080 | 3 | 25 |
| 3300HL | 3300 | 12.4 | 1205 | 35 | 1850 | 3 | 25 |

The test protocol below was run with base fuel and one test fuel (one of Examples 1-4) per day:

Warm up engine and line out on base fuel

Run baseline spark sweep: 1300 ML, HL, 3300 ML (ML=medium load; HL=high load)

Switch to test fuel and flush 30 litre

Test: spark sweep at three different conditions (1300 rpm, IMEP: 11.5 bar and 8 bar; and 3300 rpm, IMEP: 12.4 bar)

End.

Each test fuel blend was screened twice, once in each of two randomized loops (Example 2 was tested once).

Figure 2:
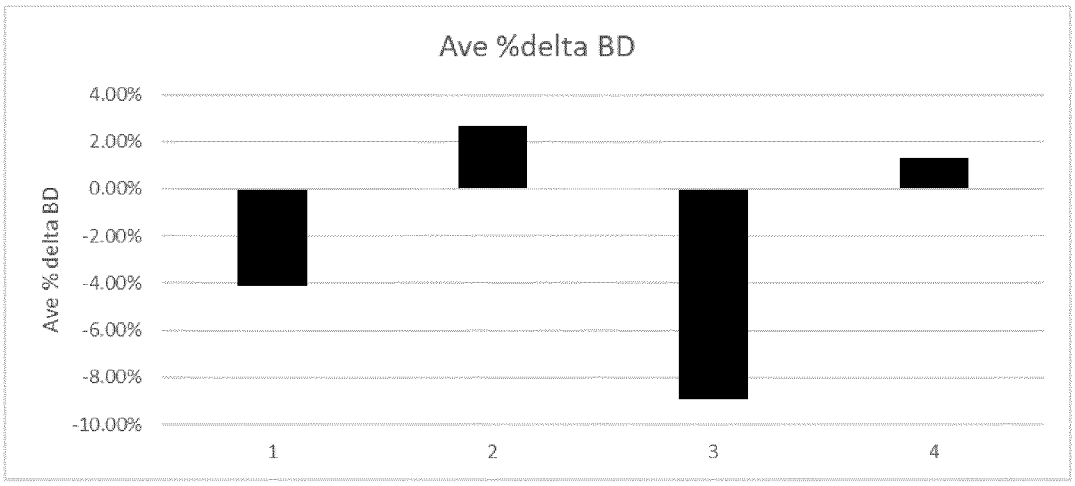
FIG. 2 is a graphical representation of the experimental data set out in Table 5.
Figure 3:
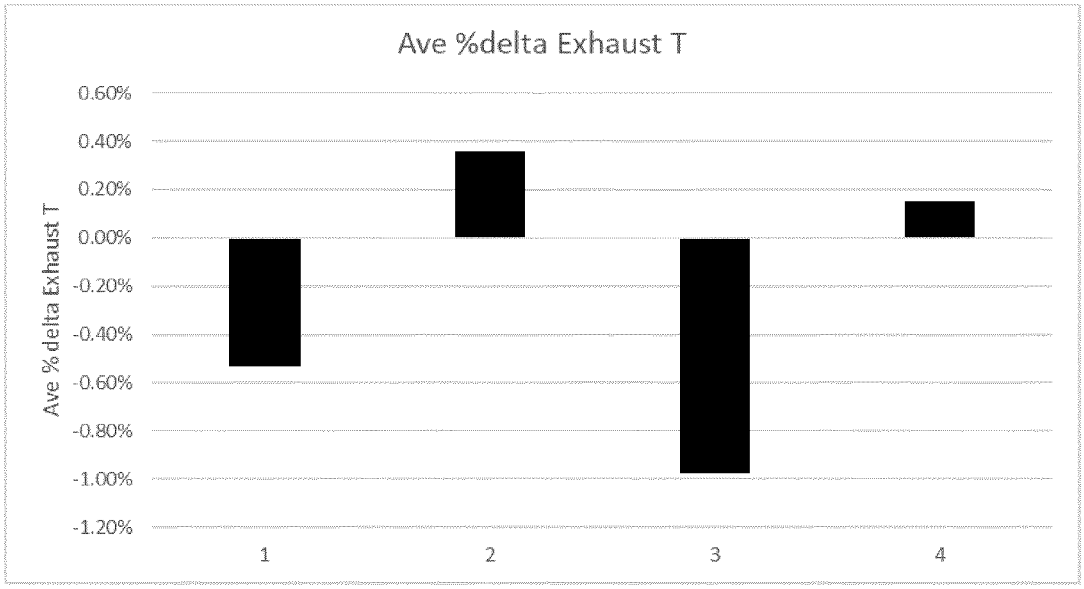
FIG. 3 is a graphical representation of the experimental data set out in Table 6 for Examples 1 to 4.
Figure 4:
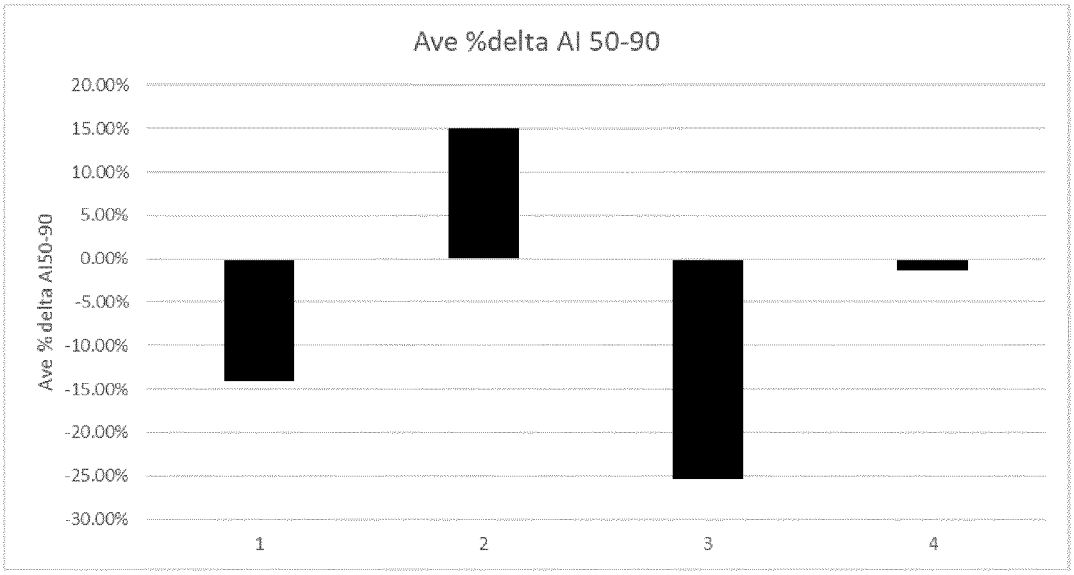
FIG. 4 is a graphical representation of the experimental data set out in Table 7 for Examples 1 to 5.

$P_{max}$, burn duration and exhaust temperature measurements were taken and the results are shown in Tables 4, 5, 6 and 7 below. Table 4 shows the average % difference in Pmax between the test blend and it's base fuel control at 1300 HL, IGN=1 (IGN=ignition time). FIG. 1 is a graphical representation of the experimental data set out in Table 4 for Examples 1 to 4 (the Example number being on the x axis and the average % difference in Pmax being on the y axis). Table 5 shows the % difference analysis in burn duration between the test blend and it's base fuel control at 1300 HL, IGN=1. FIG. 2 is a graphical representation of the experimental data set out in Table 5 for Examples 1 to 4 (the Example number being on the x axis and the % difference in burn duration being on the y axis). Table 6 shows the exhaust temperature for each test fuel and the % difference in exhaust temperature between the test blend and it's base fuel control (at 1300 HL, IGN=1). FIG. 3 is a graphical representation of the experimental data set out in Table 6 for Examples 1 to 4 (the Example number being on the x axis and the average % difference in Exhaust Temperature being on the y axis). Table 7 shows the average % difference in burn duration (AI50-90) between the test blend and it's base fuel control at at 1300 HL, IGN=1. FIG. 4 is a graphical representation of the experimental data set out in Table 7 for Examples 1 to 4 (the Example number being on the x axis and the average % difference in burn duration (AI 50-90%) being on the y axis).

TABLE 4

| Example | Loop | $P_{max}$ (bar) | Delta $P_{max}$ | % Difference $P_{max}$ | Least Sq. Mean % |
|---|---|---|---|---|---|
| 1 | 1 | 48.55 | 1.53 | 3.26% | 2.87% |
| 1 | 2 | 49.64 | 1.21 | 2.49% | |
| 2 | 1 | 45.68 | −1.96 | −4.11% | −4.11% |
| 3 | 1 | 48.62 | 2.56 | 5.57% | 5.63% |
| 3 | 2 | 48.65 | 2.62 | 5.69% | |
| 4 | 1 | 46.01 | −0.33 | −0.71% | −0.63% |
| 4 | 2 | 46.16 | −0.26 | −0.56% | |

TABLE 5

| Example | Loop | Burn duration | Delta burn duration | % Difference burn duration | Least Sq. Mean % |
|---|---|---|---|---|---|
| 1 | 1 | 13.53 | −0.79 | −5.54% | −4.14% |
| 1 | 2 | 13.19 | −0.37 | −2.75% | |
| 2 | 1 | 13.95 | 0.36 | 2.65% | 2.65% |
| 3 | 1 | 13.44 | −1.35 | −9.14% | −8.95% |
| 3 | 2 | 13.44 | −1.29 | −8.75% | |
| 4 | 1 | 14.78 | 0.20 | 1.45% | 1.29% |
| 4 | 2 | 14.71 | 0.18 | 1.23% | |

TABLE 6

| Example | Loop | Exhaust T, ° C. | Delta Exhaust T | % Difference Exhaust T | Least Sq. Mean % |
|---|---|---|---|---|---|
| 1 | 1 | 570.11 | −3.50 | −.61% | −0.53% |
| 1 | 2 | 572.55 | −2.56 | −0.45% | |
| 2 | 1 | 581.71 | 2.06 | 0.36% | 0.36% |
| 3 | 1 | 572.85 | −5.70 | −0.98% | −0.98% |
| 3 | 2 | 572.19 | −5.61 | −0.87% | |
| 4 | 1 | 578.29 | 0.80 | 0.14% | 0.15% |
| 4 | 2 | 578.59 | 0.90 | 0.16% | |

TABLE 7

| Example | Loop | Burn duration (AI50-90, deg) | Delta burn duration (AI50-90) | % Difference burn duration (AI50-90) | Least Sq. Mean % |
|---|---|---|---|---|---|
| 1 | 1 | 4.51 | −1.02 | −18.41% | −14.09% |
| 1 | 2 | 4.39 | −0.48 | −9.77% | |
| 2 | 1 | 5.80 | 0.75 | 14.97% | 14.97% |
| 3 | 1 | 4.60 | −1.50 | −24.59% | −15.37% |
| 3 | 2 | 4.47 | −1.58 | −26.15% | |
| 4 | 1 | 5.89 | −0.05 | −0.89% | −1.33% |
| 4 | 2 | 5.84 | −0.11 | −1.77% | |

Discussion

Use of a dicumene/TMB combination in a gasoline fuel composition of the present invention has been shown to provide decreased burn duration and increased P max in engine tests. Reduced Exhaust Temperature is also observed for the fuel compositions of the present invention which means improved fuel economy. The magnitude of these results are particularly surprising, especially in view of the very low levels of dicumene/TMB additive concentrations used.

We claim:

1. Liquid fuel composition comprising:

(a) a base fuel suitable for use in an internal combustion engine; and (b) a tetraalkylethane compound having the formula (I):

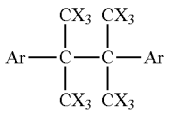

wherein Ar represents an aryl group and each X is independently selected from a hydrogen atom, substituted or unsubstituted, straight chain or branched $C_1$-$C_{12}$ alkyl group, $(CH_2)_nOH$ or $(CH_2)_nNH_2$, wherein n is in the range of 1 to 9, provided that at least one of the X groups in each $CX_3$ group is a hydrogen atom; and c) an alkylbenzene compound having the formula (II)

(II)

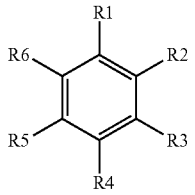

wherein each R1-R6 group is independently selected from hydrogen and a $C_1$-$C_6$ alkyl group, wherein at least one of the R1-R6 groups is a $C_1$-$C_6$ alkyl group, wherein the tetraalkylethane compound is present in the liquid fuel composition at a level from 30 ppm to 1 wt %, by weight of the liquid fuel composition, and wherein the alkylbenzene compound is present in the liquid fuel composition at a level from 30 ppm to 2 wt %, by weight of the liquid fuel composition.

2. Liquid fuel composition according to claim 1 wherein three R1-R6 groups in the alkylbenzene are independently selected from a $C_1$-$C_6$ alkyl group.

3. Liquid fuel composition according to claim 1, wherein the alkylbenzene compound is a trimethylbenzene compound.

4. Liquid fuel composition according to claim 1, wherein the alkylbenzene compound is 1,3,5-trimethylbenzene.

5. Liquid fuel composition according to claim 1, wherein Ar of the tetraalkylethane compound is a substituted or unsubstituted aromatic group selected from phenyl, biphenyl, naphthyl, thienyl or anthracyl.

6. Liquid fuel composition according to claim 1, wherein Ar is an unsubstituted phenyl group.

7. Liquid fuel composition according to claim 1, wherein each X is independently selected from a hydrogen atom, unsubstituted, straight chain or branched $C_1$-$C_6$ alkyl group, provided that at least one of the X groups in each $CX_3$ group is a hydrogen atom.

8. Liquid fuel composition according to claim 1, wherein the tetralkylethane compound is 1,1' (1,1,2,2-tetramethyl-1,1-ethanediyl)bis-benzene.

9. Liquid fuel composition according to claim 1, wherein the tetraalkylethane compound is present in the fuel composition at a level from 30 ppm to 10 wt % 5000 ppm, by weight of the liquid fuel composition %.

10. Liquid fuel composition according to claim 1, wherein the base fuel is a gasoline base fuel.

11. Liquid fuel composition according to claim 1, wherein the base fuel comprises less than 10 vol % of aromatics, based on the total base fuel.

12. Liquid fuel composition according to any of claim 1, wherein the base fuel comprises less than 2 vol % of aromatics having 9 carbon atoms or greater, based on the total base fuel.

13. Method for improving the power output of an internal combustion engine wherein the method comprises fueling the engine with a liquid fuel composition according to claim 1.

14. Method for improving the acceleration of an internal combustion engine wherein the method comprises fueling the engine with a liquid fuel composition according to claim 1.

15. Method of reducing the burn duration of a liquid fuel composition in an internal combustion engine, said method comprising fueling the internal combustion engine with a liquid fuel composition according to claim 1.

16. Method for increasing the flame speed of a liquid fuel composition in an internal combustion engine, said method comprising fueling the internal combustion engine with a liquid fuel composition according to claim 1.

* * * * *